US005909199A

United States Patent [19]

Miyazaki et al.

[11] Patent Number: 5,909,199

[45] Date of Patent: Jun. 1, 1999

[54] PLASMA DRIVING CIRCUIT

[75] Inventors: Shigeki Miyazaki, Kanagawa; Ryota Odake, Tokyo, both of Japan

[73] Assignee: Sony Corporation, Tokyo, Japan

[21] Appl. No.: 08/524,570

[22] Filed: Sep. 7, 1995

[30] Foreign Application Priority Data

Sep. 9, 1994 [JP] Japan ..... 6-241913

[51] Int. Cl.[6] ..... G09G 3/28

[52] U.S. Cl. ..... 345/60; 345/98

[58] Field of Search ..... 345/60, 68, 87, 345/37, 69, 100, 208, 207, 79, 96, 904, 66, 204, 62; 315/169.4, 169.2, 291, 307; 313/582

[56] References Cited

U.S. PATENT DOCUMENTS

| | | | |
|---|---|---|---|
| 3,922,666 | 11/1975 | Inami et al. | 345/37 |
| 4,077,033 | 2/1978 | Strom | 345/69 |
| 4,099,097 | 7/1978 | Schermerhorn et al. | 345/60 |
| 4,147,960 | 4/1979 | Andoh et al. | 315/169.2 |
| 4,180,762 | 12/1979 | Weber | 315/169.4 |
| 4,189,729 | 2/1980 | Baker et al. | 345/69 |
| 4,333,039 | 6/1982 | Strom | 345/60 |
| 4,866,349 | 9/1989 | Weber et al. | 345/68 |
| 4,896,149 | 1/1990 | Buzak et al. | 345/68 |
| 5,077,553 | 12/1991 | Buzak | 345/60 |
| 5,446,344 | 8/1995 | Kanazawa | 315/169 |
| 5,563,624 | 10/1996 | Imamura | 345/100 |
| 5,696,522 | 12/1997 | Iwama | 345/60 |
| 5,706,020 | 1/1998 | Iwama | 345/60 |

FOREIGN PATENT DOCUMENTS

| | | |
|---|---|---|
| 0 044 182 | 1/1982 | European Pat. Off. . |
| 0 261 584 | 3/1988 | European Pat. Off. . |
| 0 377 955 | 7/1990 | European Pat. Off. . |
| 0 549 275 | 6/1993 | European Pat. Off. . |
| 07210112 | 8/1995 | Japan . |

*Primary Examiner*—Chanh Nguyen
*Assistant Examiner*—John Suraci
*Attorney, Agent, or Firm*—Hill & Simpson

[57] ABSTRACT

A plasma driving circuit for sequentially discharging and driving a plurality of plasma channels. The circuit comprises a plurality of complementary switches provided correspondingly to the plasma channels; a constant current source connected in common to each of the complementary switches and supplying a predetermined discharge current thereto; a scanner for sequentially controlling the on/off actions of the complementary switches and distributing the discharge current to the corresponding plasma channels; and a suppressing circuitry included in the output stage of each of the complementary switches and serving to suppress the output of a rush current which results from a capacitive component existent in each of the complementary switches. The suppressing means is a diode element having a capacitive component sufficiently smaller than the capacitive component existent in each complementary switch, and a resistance element is connected in series to the diode element. The resistance value of the resistance element is so optimized as not to limit the discharge current substantially but to be adapted for suppressing the rush current effectively.

8 Claims, 12 Drawing Sheets

PLASMA DRIVING CIRCUIT

BACKGROUND OF THE INVENTION

1. Field of the Invention

The present invention relates to a circuit for driving a plasma cell used in a display device or the like, and more particularly to a plasma driving circuit for sequentially discharging and driving a plurality of plasma channels provided in a plasma cell. And further particularly the invention relates to a technique of suppressing a rush current (surge) derived from an internal capacity of a plasma driving circuit.

2. Description of Related Art

It has been known heretofore that a plasma cell having a plurality of plasma channels is employed in a plasma display device (PDP). Relative to a plasma addressed liquid crystal display device (PALC) where a plasma cell is utilized for addressing a display cell, exemplary ones are disclosed in U.S. Pat. No. 4,896,149 to Buzak (Issue date: Jan. 23, 1990) and U.S. Pat. No. 5,077,553 to Buzak (Issue date: Dec. 31, 1991). In such display devices, each of the plasma channels is equipped with an anode and a cathode as a pair of discharge electrodes. The plasma driving circuit connected to the plasma cell sequentially supplies a discharge voltage between the anodes and the cathodes of the individual plasma channels to thereby generate plasma discharges. In utilizing a plasma cell for a PDP or a PALC, it is necessary to generate stable plasma discharges in the individual plasma channels without any secular change that may be caused with a lapse of time.

However, in generation of a plasma discharge, there may occur a case where an unintended and unrequired current (rush current) flows from a plasma driving circuit. Such a rush current results from the internal capacity of the plasma driving circuit and, since it is difficult to control the flow thereof, the rush current renders the plasma discharge unstable. Generally, the service life of a plasma cell consisting of a structure with a set of plasma channels is in inverse proportion to the square or cube of discharge current, whereby there is raised a problem that the service life is shortened correspondingly to the addition of rush current.

SUMMARY OF THE INVENTION

It is therefore an object of the present invention to provide an improved plasma driving circuit which is adapted to eliminate the drawbacks observed in the previously proposed technique and to realize a prolonged service life of a plasma cell and stabilized plasma discharge by suppressing any unrequired rush current that flows to each plasma channel.

According to one aspect of the present invention, there is provided a plasma driving circuit which fundamentally comprises a plurality of complementary switches, a constant current source and a scanner so as to sequentially discharge and drive a plurality of plasma channels. The plurality of complementary switches are provided correspondingly to individual plasma channels. The constant current source is connected in common to each of the complementary switches and supplies a constant discharge current thereto. And the scanner sequentially turns on and off the complementary switches under control to thereby distribute the discharge current sequentially to the corresponding plasma channels. As a characteristic requisite of the present invention, each complementary switch includes a suppressing means in its output stage to suppress the output of a rush current resulting from a capacitive component which is existent in the relevant complementary switch. The suppressing means may be a diode element whose capacitive component is sufficiently smaller than that existent in the complementary switch. The suppressing means preferably includes a resistance element connected in series to the diode element. And its resistance value is preferably so optimized as not to limit the discharge current substantially but to be adapted for suppressing the rush current effectively.

In the present invention, the output capacity of the plasma driving circuit is reduced by additionally connecting a diode element to the output of the circuit. And due to further additional connection of an optimized resistance element to the output of the plasma driving circuit, it becomes possible to efficiently suppress the rush current. Such configuration is effective for suppressing any unrequired current that flows from the plasma driving circuit to each of the plasma channels, hence realizing a prolonged service life of the plasma cell and stabilizing the plasma discharge.

The above and other features and advantages of the present invention will become apparent from the following description which will be given with reference to the illustrative accompanying drawings.

DESCRIPTION OF THE PREFERRED EMBODIMENTS

Figure 1:
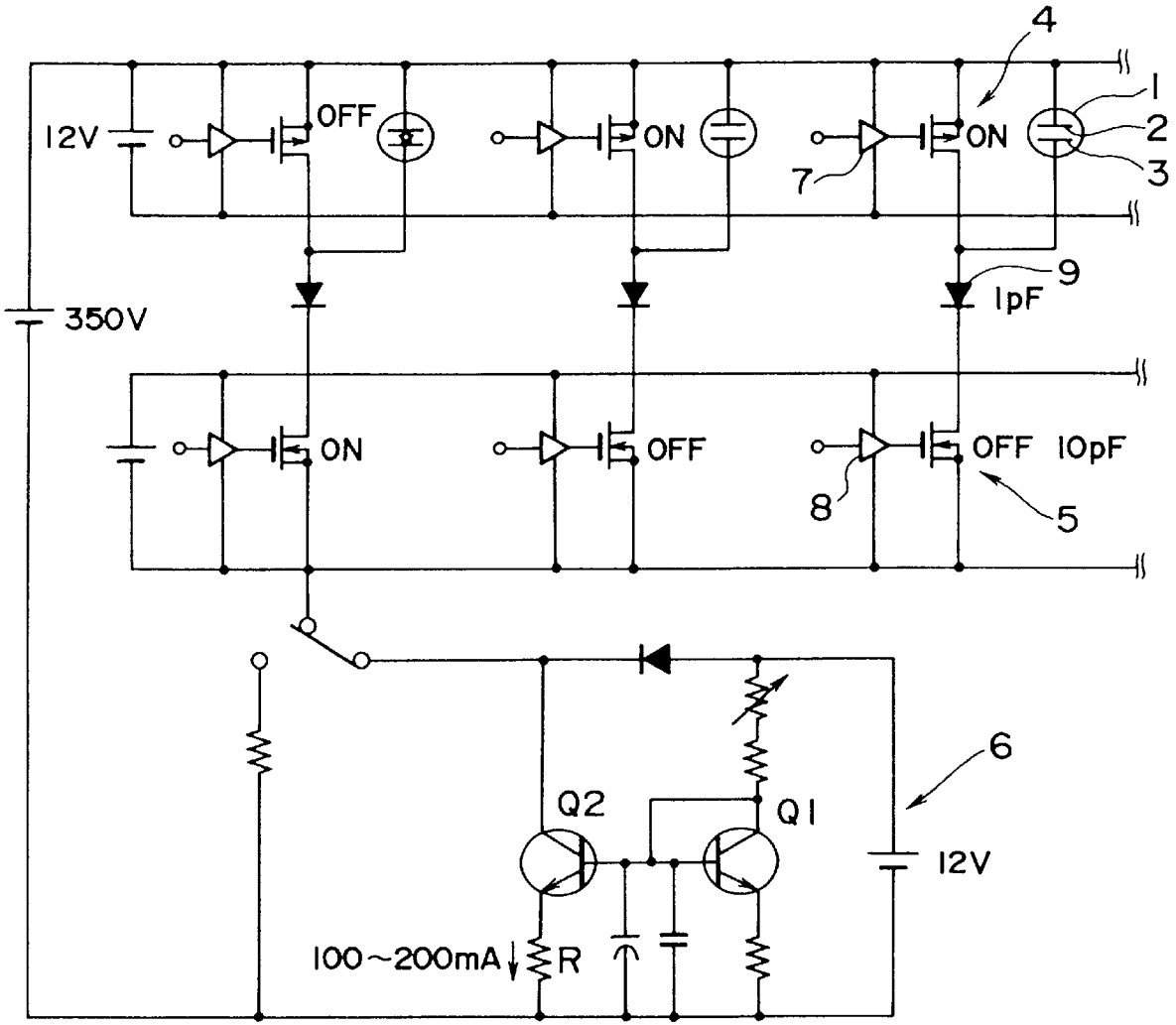
FIG. 1 is a circuit diagram of a first embodiment representing the plasma driving circuit of the present invention.

Hereinafter some preferred embodiments of the present intention will be described in detail with reference to the accompanying drawings. FIG. 1 is a circuit diagram of a first embodiment representing the plasma driving circuit of the present invention. As shown in the diagram, the plasma driving circuit is so formed as to discharge and drive a plurality of plasma channels 1 sequentially. Each of the plasma channels 1 has an anode (A) 2 and a cathode (K) 3 as a pair of discharge electrodes. And a plasma discharge is generated when a predetermined discharge current is supplied between the anode 2 and the cathode 3. A plurality of such plasma channels 1 are assembled to constitute a plasma cell for use in a PDP or a PALC. When a plasma cell is incorporated in a PALC for example, the number of required plasma channels is equal to that of picture scanning lines, e.g., 480. The plasma driving circuit of the invention includes a plurality of complementary switches correspondingly to the individual plasma channels 1. In this first embodiment, each complementary switch consists of a P-type transistor 4 and an N-type transistor 5 which form a pair. A source electrode of the P-type transistor 4 is connected to the anode 2 of the corresponding plasma channel 1, and its drain electrode is connected to the cathode 3 of the corresponding plasma channel 1. Meanwhile a drain electrode of the N-type transistor 5 is connected to the cathode 3 of the corresponding plasma channel 1, and its source electrode is connected in common. Therefore the P-type transistor 4 and the N-type transistor 5 are connected in series to each other, and the middle node thereof is connected as an output terminal to the cathode 3. A constant current source 6 is connected to the common-connected source electrodes of the entire N-type transistors 5 so as to supply a constant discharge current (100 to 200 mA) to each complementary switch. A gate driver 7 is connected to the gate electrode of each P-type transistor 4, while a gate driver 8 is connected to the gate electrode of each N-type transistor 5. The on/off actions of the complementary switches are sequentially controlled by means of a scanner (not shown) via the gate drivers 7 and 8, so that the discharge current supplied from the constant current source 6 is sequentially distributed to the corresponding plasma channels 1. In the leftmost complementary switch in the shown example, its P-type transistor is in an off-state while its N-type transistor is in an on-state. Consequently the first plasma channel is connected to the constant current source 6, so that a plasma discharge is generated. However, in the second complementary switch, its P-type transistor is in an on-state while its N-type transistor is in an off-state. Consequently the relevant plasma cell 1 is disconnected from the constant current source 6, so that no plasma charge is generated. At this time, the paired anode and cathode are short-circuited by the P-type transistor in an on-state. Similarly the third plasma channel 1 is also disconnected from the constant current source 6, so that no plasma discharge is generated either. Thus, with such rightward sequential on/off control of the P-type and N-type transistors included in the individual complementary switches, it becomes possible to sequentially select, discharge and drive the plurality of plasma channels.

As a characteristic requisite of the present invention, a suppressing means is included in the output stage of each complementary switch so as to suppress the output of a rush current resulting from the capacitive component existent in the complementary switch. More specifically, the suppressing means consists of a diode element 9 inserted in the output stage of each complementary switch. The diode element 9 has a capacitive component (e.g., 1 pF) sufficiently smaller than the capacitive component existing in the complementary switch (i.e., the source-drain capacity (10 pF or so) of the N-type transistor 5). Thus, when the diode element 9 having a capacitive component sufficiently smaller than the internal capacity of the complementary switch is inserted in the output terminal as described above, the output capacity of the plasma driving circuit is equivalently lowered to achieve suppression of the rush current.

Figure 2:
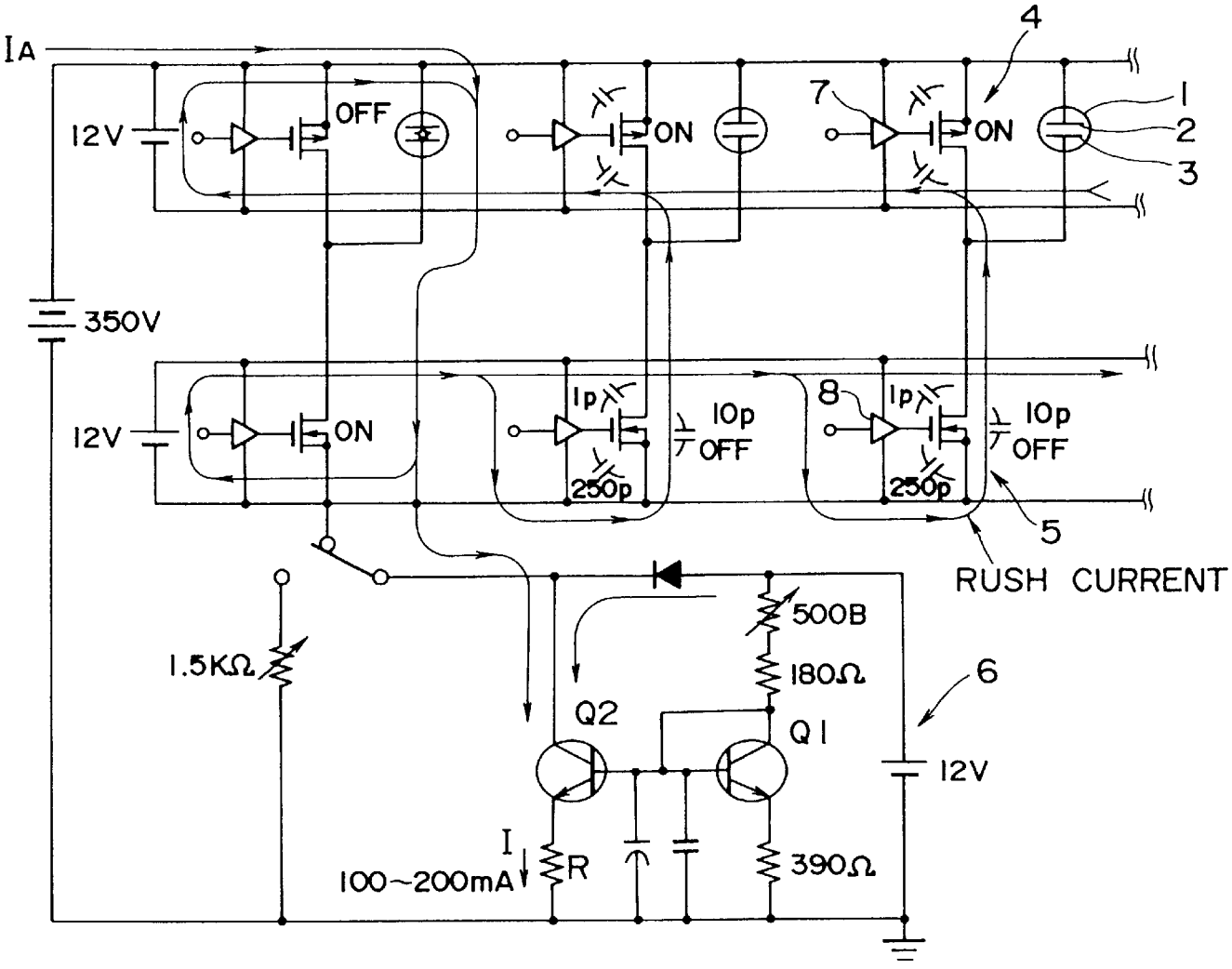
FIG. 2 is a circuit diagram showing a flow path of a rush current resulting from an internal capacity of the plasma driving circuit.

FIG. 2 is a circuit diagram showing a flow path of a rush current, wherein any component parts corresponding to those in FIG. 1 are denoted by like reference numerals to make the configuration better understood. However, each diode element 9 serving as a suppressing means is omitted in this diagram so as to show a rush current flow path. As described above, a plurality of complementary switches are provided correspondingly to a plurality of plasma channels 1. Each of the complementary switches consists of a P-type transistor 4 and an N-type transistor 5 forming a pair. Gate drivers 7 and 8 are connected to the transistors 4 and 5, respectively. A constant current source 6 is connected in common to the individual complementary switches. The first plasma channel 1 is selected in the state shown as an example, wherein a discharge current (anode current) $I_A$ flows along a normal path denoted by a thick line. Meanwhile a rush current flows separately therefrom along an internal path denoted by a thin line. Since this rush current flows in the selected first plasma channel by way of the internal path (closed loop), it is impossible to control the rush current by the constant current circuit 6 differently from the anode current $I_A$. The generation of such rush current is based on the phenomenon that the charge stored in the output capacity between the sources and the drains of the second and succeeding N-type transistors 5 in an off-state flows by way of the internal path denoted by a thin line. In a case where a total of 500 N-type transistors 5 in an off-state are included for example, the charge accumulated in the sum (approx. 5 nF) of the output capacity (10 pF or so) of each N-type transistor forms a rush current which flows in one selected plasma channel, whereby a considerably great current load is produced.

Figure 3A:
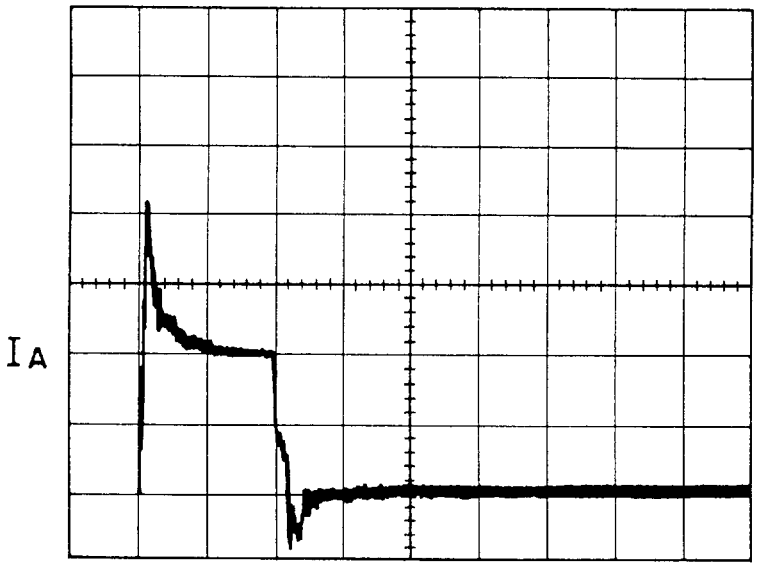
FIGS. 3A and 3B show waveforms of an anode current $I_A$, a plasma luminous intensity $E_L$ and a cathode voltage $V_K$ measured in the circuit of FIG. 2 by an oscilloscope.
Figure 3B:
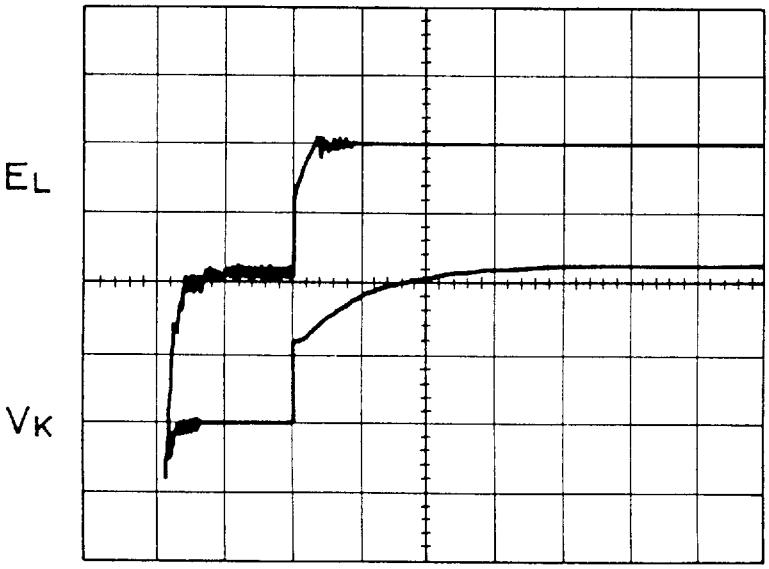

FIGS. 3A and 3B are oscillograms each showing an aspect of a plasma discharge generated in the plasma driving circuit of FIG. 2. As graphically shown in FIG. 3A, an undesirable rush current is observed in the anode current $I_A$. This oscillogram is so scaled that one graduation of the abscissa indicates 5 $\mu$s, and one graduation of the ordinate indicates 50 mA. It is ideal that the anode current $I_A$ is square in waveform, but actually an undesirable rush current appears at the rise time. Such a rush current is not required essentially, and it raises serious problems of shortening the service life of the plasma cell and rendering the discharge unstable. FIG. 3B is an oscillogram showing waveforms of a cathode voltage $V_K$ and a luminous intensity $E_L$ of a plasma discharge, wherein the upper one of two curves denotes $E_L$ while the lower one denotes $V_K$. In this oscillogram, one graduation of the abscissa indicates 5 $\mu$s, and one graduation of the ordinate indicates 100 V. As obvious from the curve of $E_L$, there is observed an undesirable rush discharge caused by an undesirable rush current. The luminous intensity $E_L$ of a plasma discharge is the one detected by the use of a photomultiplier, and this oscillogram represents the detected voltage thereof.

Figure 4A:
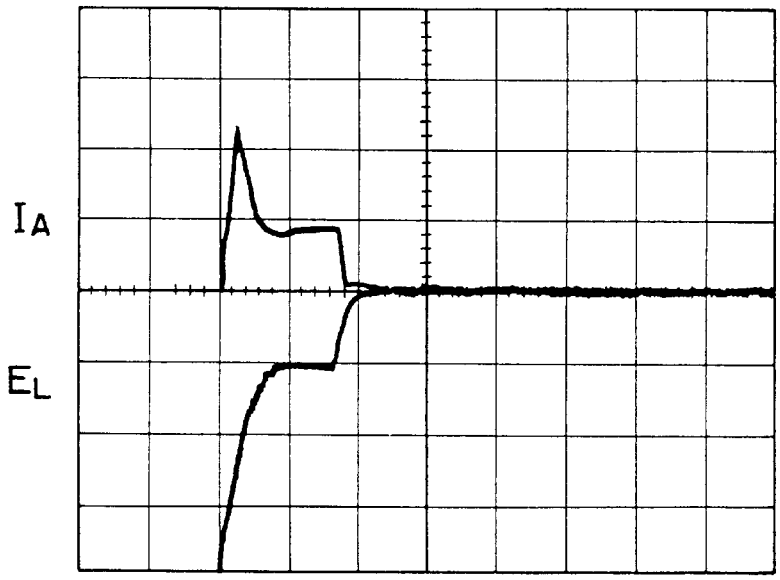
FIGS. 4A and 4B show waveforms of anode currents $I_A$ and plasma luminous intensities $E_L$ measured in the circuit of FIG. 2 by the oscilloscope under the conditions with and without a load resistance, respectively.
Figure 4B:
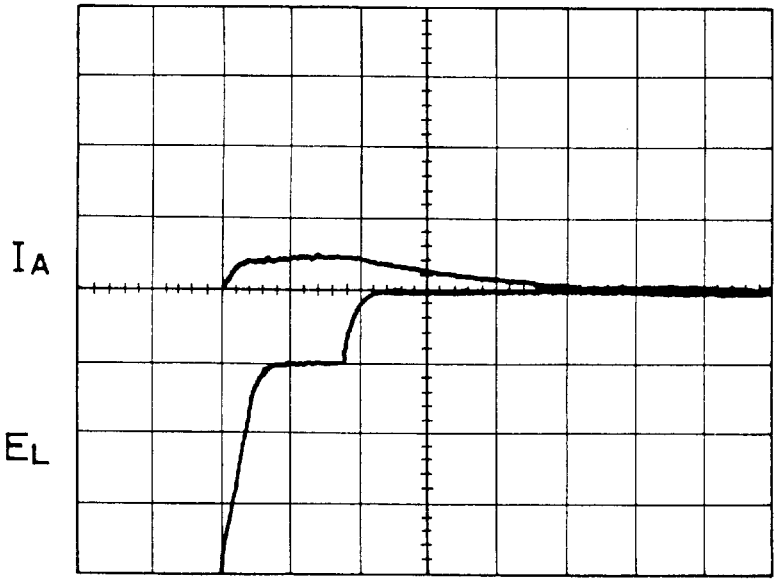

FIGS. 4A and 4B are oscillograms showing the results of simultaneous measurements of anode currents $I_A$ and plasma luminous intensities $E_L$. The waveform of FIG. 4A represents the result of a measurement obtained without connecting any load resistance to the anode side in the configuration of the plasma driving circuit shown in FIG. 2. In a case where none of load resistance is inserted, the anode current $I_A$ and the plasma luminous intensity $E_L$ conform to each other in waveform and are reasonable. Meanwhile the waveform of FIG. 4B represents the result of another measurement obtained by additionally connecting a predetermined resistance to the anode side. As shown, the anode current $I_A$ is suppressed by insertion of the load resistance and its waveform is rounded, whereas the waveform of the plasma luminous intensity $E_L$ remains substantially unchanged. Thus, $I_A$ and $E_L$ are not coincident mutually to thereby verify the existence of an independent discharge current path (i.e., rush current path) in the plasma driving circuit. For the purpose of suppressing such rush current, a diode element is inserted in the drain side (output stage) of an N-type transistor, as shown in FIG. 1. Although the diode element itself also has a capacitive component, its value is settable to be sufficiently smaller than that of the N-type transistor. Consequently the total capacitive component is reducible to be less than 1/10 (10 pF to 1 pF), hence diminishing the rush current in accordance with such reduction.

Figure 5B:
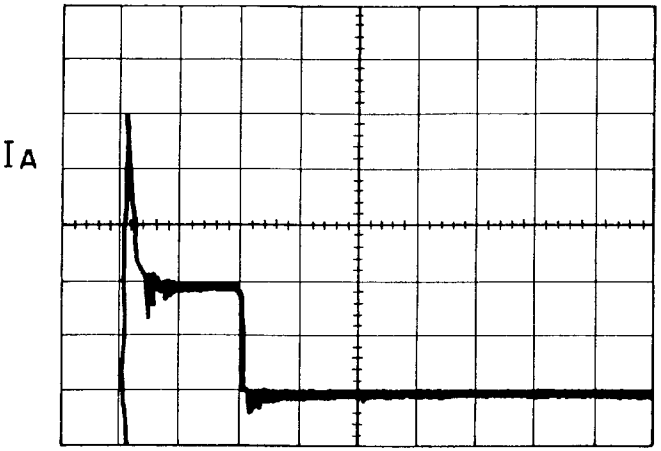
FIGS. 5A to 5D are waveforms of anode currents $I_A$, plasma luminous intensities $E_L$ and cathode voltages $V_K$ measured in the circuit of FIG. 2 by the oscilloscope under the conditions with and without a diode element, respectively.
Figure 5A:
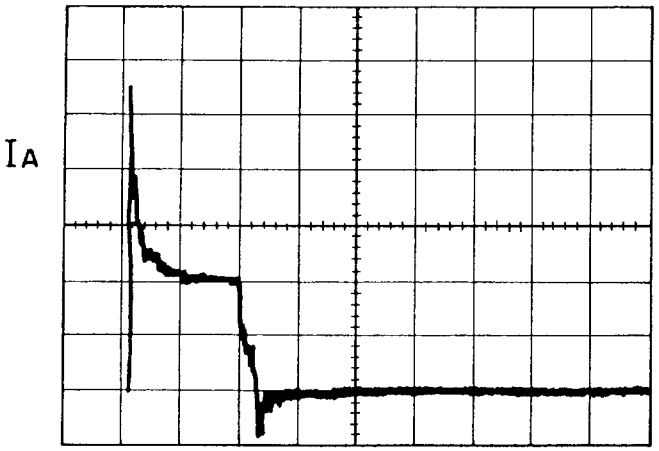

FIGS. 5A through 5D are oscillograms showing the effects of a diode element. The waveform of FIG. 5A represents an anode current $I_A$ obtained without insertion of any diode element. In this graph, one graduation of the abscissa indicates 5 $\mu$m, and that of the ordinate indicates 50 mA. There is seen a great amount of rush current flowing during a period of 2 $\mu$s or so at the rise time. Meanwhile the waveform of FIG. 5B represents an anode current $I_A$ obtained with insertion of a diode element. Due to connection of a diode element to the output stage of a complementary switch, the rush current is diminished to be less than 1/10, so that there is left merely a slight surge corresponding to the response (time constant) of the constant current circuit.

Figure 5D:
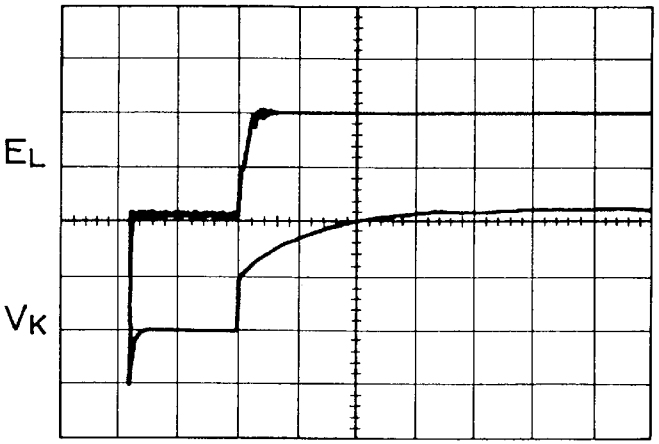
Figure 5C:
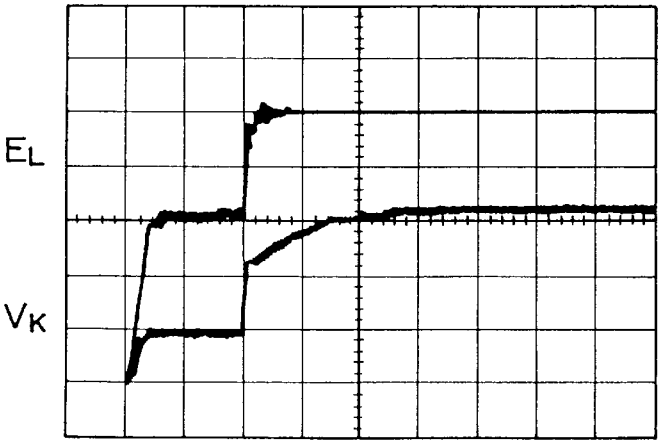

The waveform of FIG. 5C represents a plasma luminous intensity $E_L$ and a cathode voltage $V_K$ obtained without using any diode element. In this graph, one graduation of the abscissa indicates 5 $\mu$s, and that of the ordinate indicates 100 V. Meanwhile the waveforms of FIG. 5D represent a plasma luminous intensity $E_L$ and a cathode voltage $V_K$ obtained with insertion of a diode element. As obvious from a comparison of the above two graphs, the rush discharge and so forth are restrained by the suppression of the rush current. In each of these oscillograms, the upper curve denotes $E_L$ while the lower curve denotes $V_K$.

Figure 6:
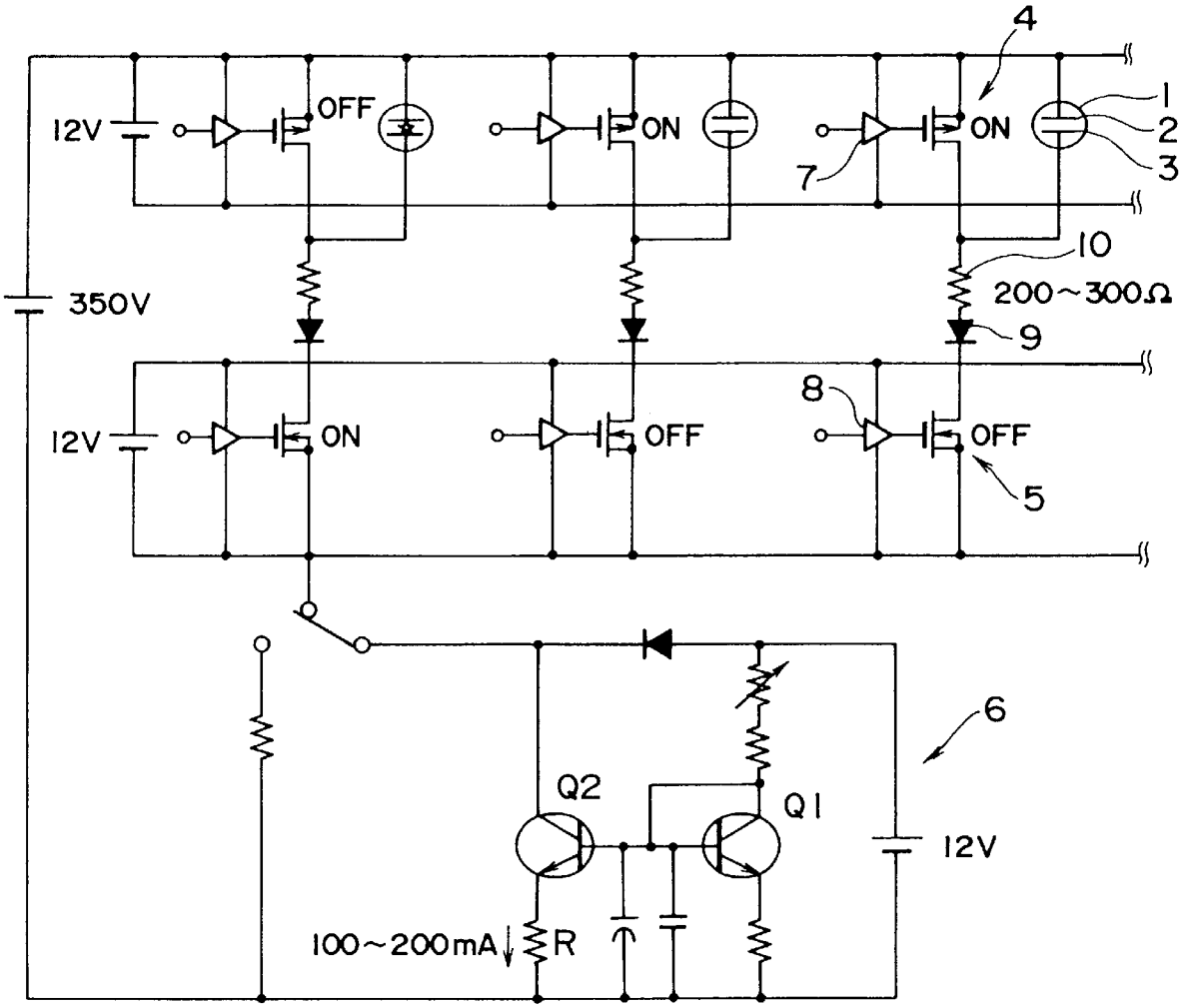
FIG. 6 is a circuit diagram of a second embodiment representing the plasma driving circuit of the present invention.

FIG. 6 is a circuit diagram of a second embodiment representing the plasma driving circuit of the present invention. The fundamental configuration thereof is the same as that of the above-described first embodiment shown in FIG. 1, and any component parts in FIG. 6 corresponding to those in FIG. 1 are denoted by like reference numerals to make the circuit better understood. The point different from the first embodiment resides in that a resistance element 10 is connected in series to the diode element 9. This resistance element 10 is inserted for elimination of the slight surge corresponding to the response of the aforementioned constant current circuit. In other words, the resistance element 10 is inserted for the purpose of rounding the rise of an anode current. The resistance value of this element 10 is so optimized as not to limit the discharge current substantially but to be adapted for suppressing the rush current effectively. In this embodiment, for example, the resistance value of the element 10 is set in a range of 200 to 300 ohms. However, since this resistance value is dependent on the size of the plasma cell and so forth, it is necessary that the resistance value be optimized individually.

Figure 7A:
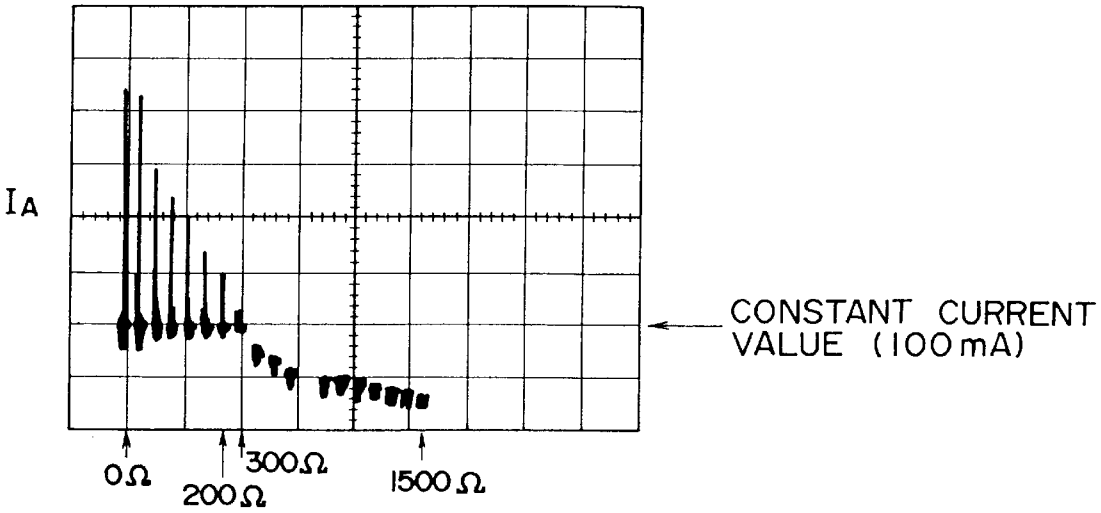
FIGS. 7A to 7C show waveforms of anode currents $I_A$, plasma luminous intensities $E_L$ and cathode voltages $V_K$ obtained by the oscilloscope while changing the resistance value of a resistance element.
Figure 7B:
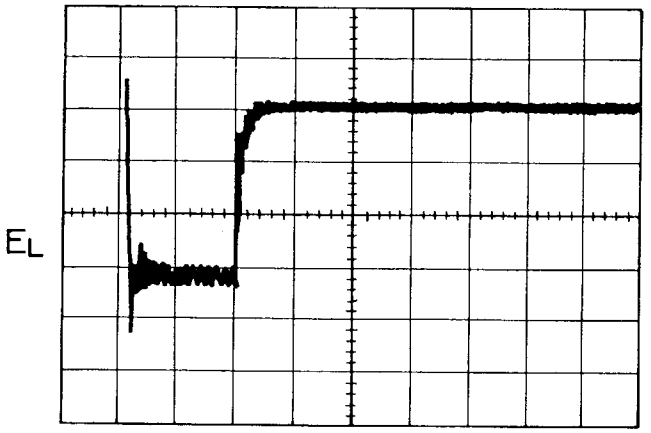
Figure 7C:
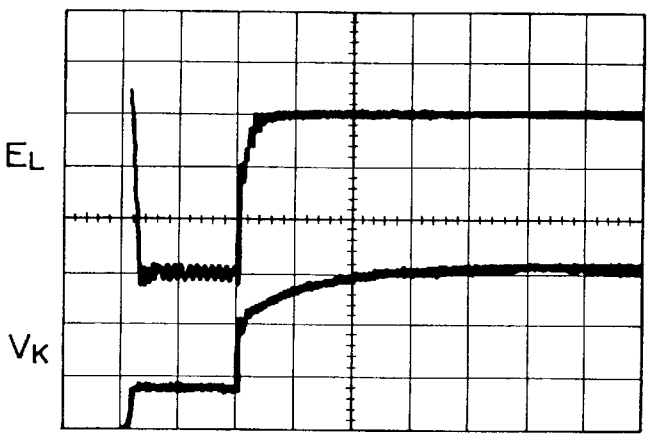

FIGS. 7A through 7C are oscillograms which express the effects achieved by additional connection of a resistance element 10 to a suppressing means. FIG. 7A shows an anode current $I_A$ obtained with change of the resistance value of the element 10, wherein one graduation of the ordinate indicates 50 mA, and the time taken along the abscissa is compressed on scale. The resistance value of the element 10 is changed from 0 to 1500 ohms in this example. As manifest from the result of the measurement, the surge suppression effect is low if the resistance value is excessively small. However, in a case where the resistance value is excessively large to the contrary, it becomes impossible to cause proper flow of a required current (constant current value: 100 mA). It is seen therefore that, in this example, the optimal resistance value of the element 10 ranges from 200 to 300 ohms. The plasma cell employed in this measurement is of 14-inch size. Assuming that a plasma cell of any greater size is used, the resistance value of the element 10 may be reduced correspondingly thereto. The oscillogram of FIG. 7B shows the plasma luminous intensity $E_L$ obtained when the resistance value is zero. Meanwhile the waveforms of FIG. 7C show the plasma luminous intensity $E_L$ and the cathode voltage $V_K$ obtained when the resistance value is 300 ohms. As obvious from a comparison of the two graphs, the rush discharge resulting from any surge can be suppressed by inserting a resistance element. In each of the above oscillograms, one graduation of the abscissa indicates 5 $\mu$s, and that of the ordinate indicates 100 V.

Nearly the entire rush current can be suppressed by carrying out the countermeasures described above, hence realizing a prolonged service life of the plasma cell and stabilization of the discharge. It is a matter of course that the diode elements and the resistance elements can be formed into an integrated circuit together with the complementary switches, whereby the production cost is not increased so much.

Figure 8:
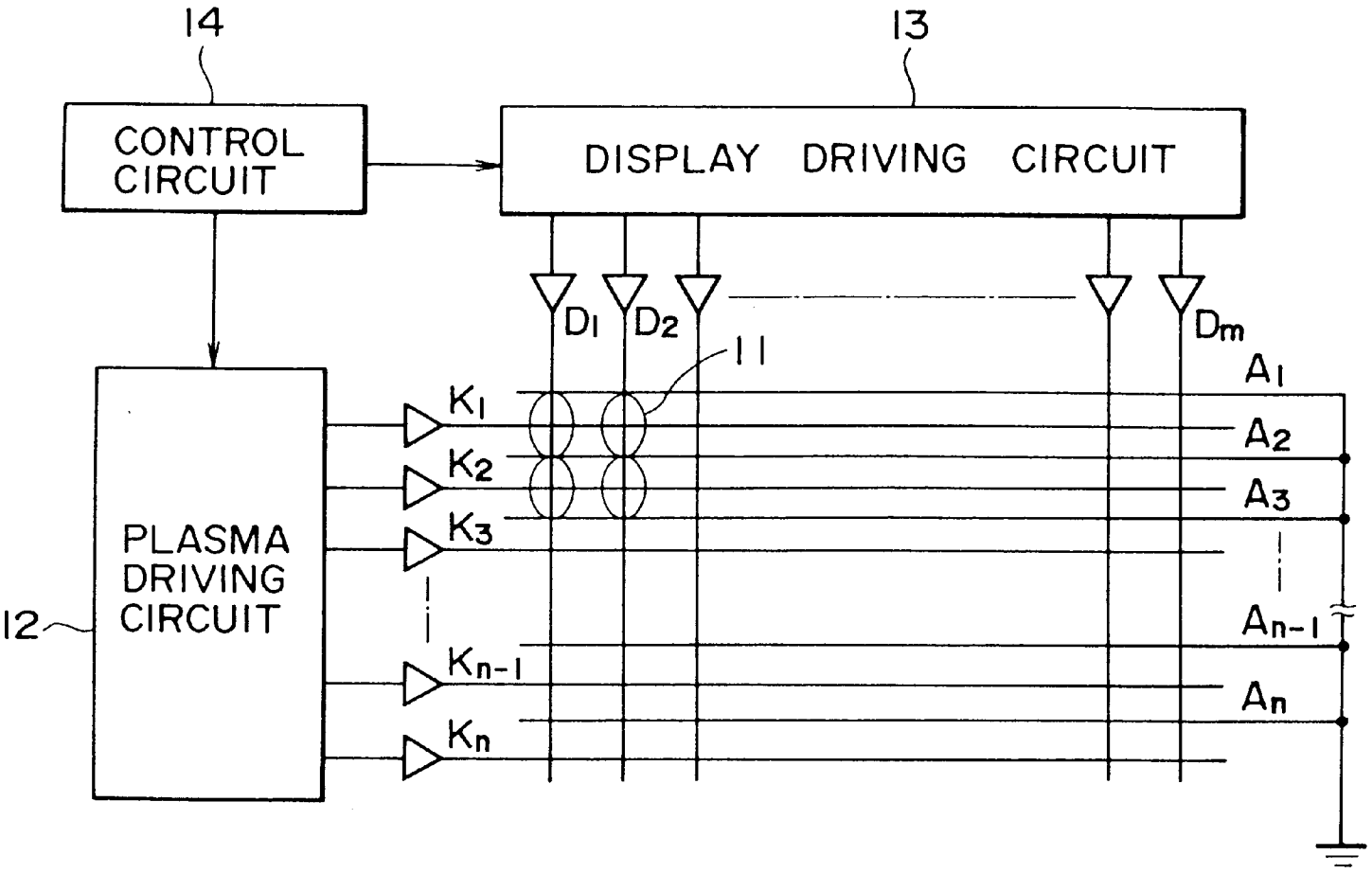
FIG. 8 is a block diagram of an exemplary plasma addressed liquid crystal display device where the plasma driving circuit of the present invention is incorporated.

FIG. 8 is a block diagram showing an exemplary application of the plasma driving circuit according to the present invention. In this example, the plasma driving circuit is employed to drive a plasma addressed liquid crystal display device. The liquid crystal display device has a flat panel structure where a liquid crystal cell and a plasma cell are superposed. As shown in the diagram, the liquid crystal cell comprises a plurality of data electrodes D1, D2, . . . , Dm arrayed in columns, while the plasma cell comprises a plurality of plasma channels arrayed in rows. Each of the plasma channels consists of an anode A and a cathode K which form a pair. The cathodes K1, K2, K3, . . . , Kn−1, Kn are arrayed sequentially in the vertical direction, while the anodes A1, A2, A3, . . . , An−1, An are arrayed alternately to the cathodes and are grounded to a reference voltage $V_0$. And pixels 11 arrayed in the form of a matrix are prescribed between the column data electrodes D and the row plasma channels (K, A). This liquid crystal display device further comprises a plasma driving circuit 12, wherein selection pulses are applied to the cathodes K of the plasma channels with line-sequential scanning, whereby plasma discharges are generated in the plasma channels. This plasma driving circuit 12 may be composed of such a circuit configuration as that shown in FIG. 1 or 6. The display device further includes a display driving circuit 13, wherein picture signals are successively applied to the data electrodes D in synchronism with the line-sequential scanning so that a desired picture is displayed. The plasma driving circuit 12 and the display driving circuit 13 are controlled synchronously with each other by a control circuit 14.

Figure 9:
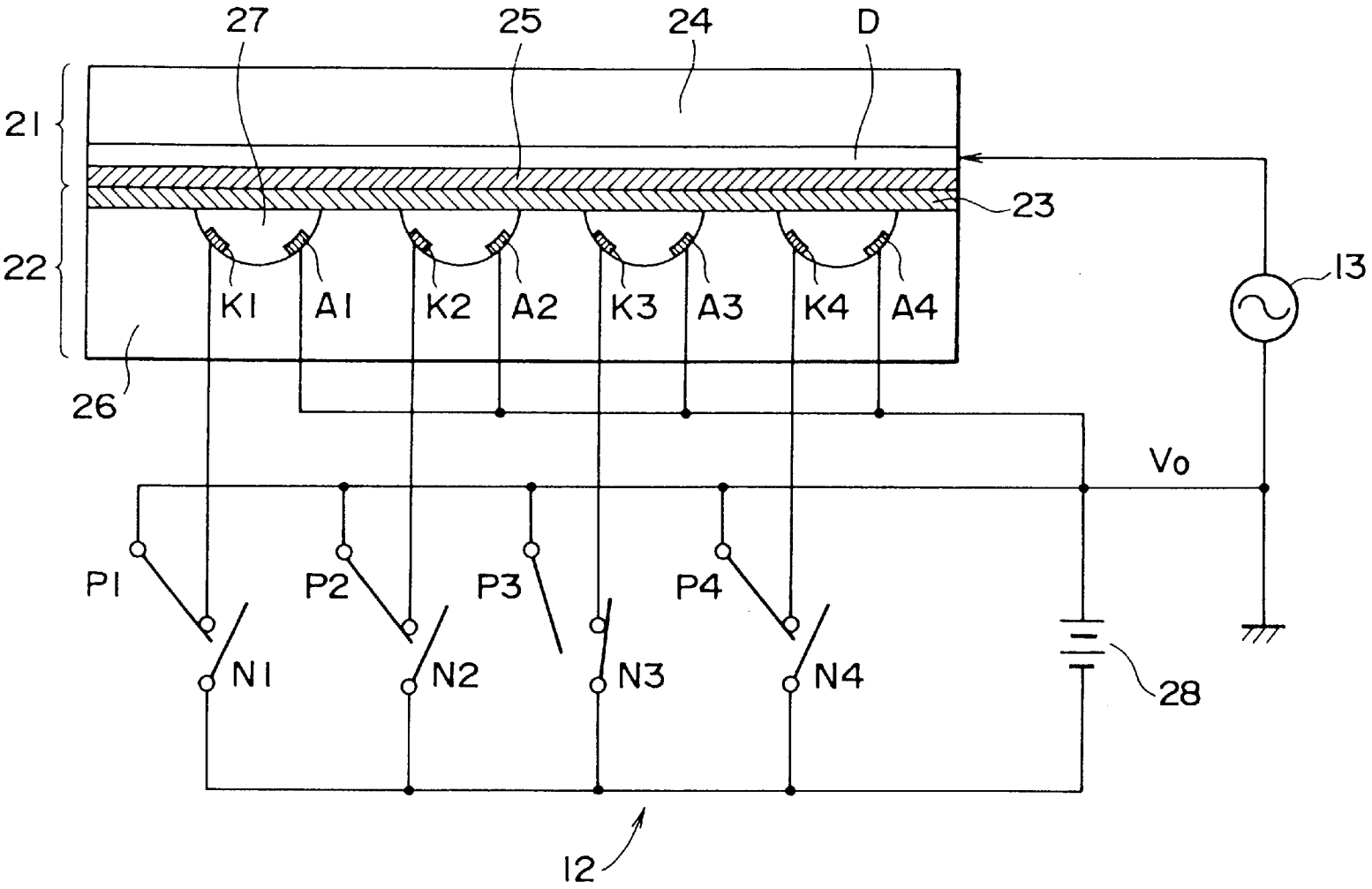
FIG. 9 is a block diagram showing a concrete structure of the plasma addressed liquid crystal display device shown in FIG. 8.

FIG. 9 typically shows an actual structure of the plasma addressed liquid crystal display device in FIG. 8. This device has a laminated flat panel structure where a liquid crystal cell 21 and a plasma cell 22 are superposed integrally via a microsheet glass 23 as a dielectric sheet. The liquid crystal cell 21 is composed by the use of an upper glass substrate 24 and is stuck to the microsheet glass 23 with a predetermined gap kept therebetween. This gap is filled with a liquid crystal layer 25. And a plurality of striped data electrodes D are provided on the inner surface of the glass substrate 24.

The plasma cell 22 is composed by the use of a lower glass substrate 26. And a plurality of striped grooves 27 are formed in the inner surface of the glass substrate 26. These grooves 27 intersect orthogonally with the data electrodes D and have paired electrodes of anodes/cathodes A1/K1, A2/K2, A3/K3 and A4/K4 therein. The grooves 27 are hermetically sealed up with the microsheet glass 23 to thereby form plasma channels which are separated individually from one another, and an ionizable gas is contained therein.

As described above, the display driving circuit 13 is connected to each of the data electrodes D, and a desired picture signal is applied thereto. In this example, the display driving circuit 13 is typically illustrated as a signal source for the purpose of making the diagram better understood, and it is grounded to a predetermined reference potential $V_0$. Meanwhile the aforementioned plasma driving circuit 12 is connected to each of the paired electrodes of anodes/cathodes A1/K1, A2/K2, A3/K3, A4/K4 and, with line-sequential scanning of the row plasma channels, a predetermined discharge current is applied during the respective selected periods. For this purpose, a constant current source 28 is provided. Further, complementary switches P1/N1, P2/N2, P3/N3 and P4/N4 are provided correspondingly to the plasma channels. Each of such complementary switches can be composed by combining a P-type transistor and an N-type transistor. In the state shown in the diagram, the third plasma channel is selected while the remaining plasma channels are not selected. In a non-selected state, a P-type transistor is closed while an N-type transistor is open, whereby the cathode of each non-selected plasma channel is connected to the reference potential (anode potential) $V_0$. However, in a selected state, the relevant complementary switch is changed so that its P-type transistor is opened while its N-type transistor is closed. When the discharge current once applied is released, the complementary switch is changed again momentarily so that its P-type transistor is closed while its N-type transistor is opened.

Finally, referring to Table 1 and FIGS. 10A through 12, some measured data of the plasma driving circuit according to the present invention will be introduced below for reference. As described above, the current determined by the internal capacity of the plasma driving circuit connected in series to the plasma cell flows in as a rush current in addition to the essential constant current, hence exerting harmful influence on the service life of the plasma cell. If the plasma driving circuit has a great internal capacity, picture distortion that results from some undesirable discharge due probably to deterioration of the discharge electrodes tends to occur in an early stage. With regard to this point, an aging experiment was conducted while varying the internal capacity (total) of the plasma driving circuit, and the generation time of undesirable discharge (arc discharge or the like) was measured. The plasma cell used for the measurement was one incorporated in the plasma addressed liquid crystal display device, and the discharge condition for each plasma channel was 300 V/100 mA (per line), which was set in a constant current circuit. The result of such measurement is shown in Table 1 below.

TABLE 1

| Internal capacity (Total) | Undesirable discharge generation time |
|---|---|
| 1 nF | 90 minutes |
| 10 nF | 10 minutes |

As obvious from the above table, the undesirable discharge generation time was 90 minutes when the internal capacity was 1 nF. In comparison therewith, the generation time was 10 minutes when the internal capacity was 10 nF.

Figure 10A:
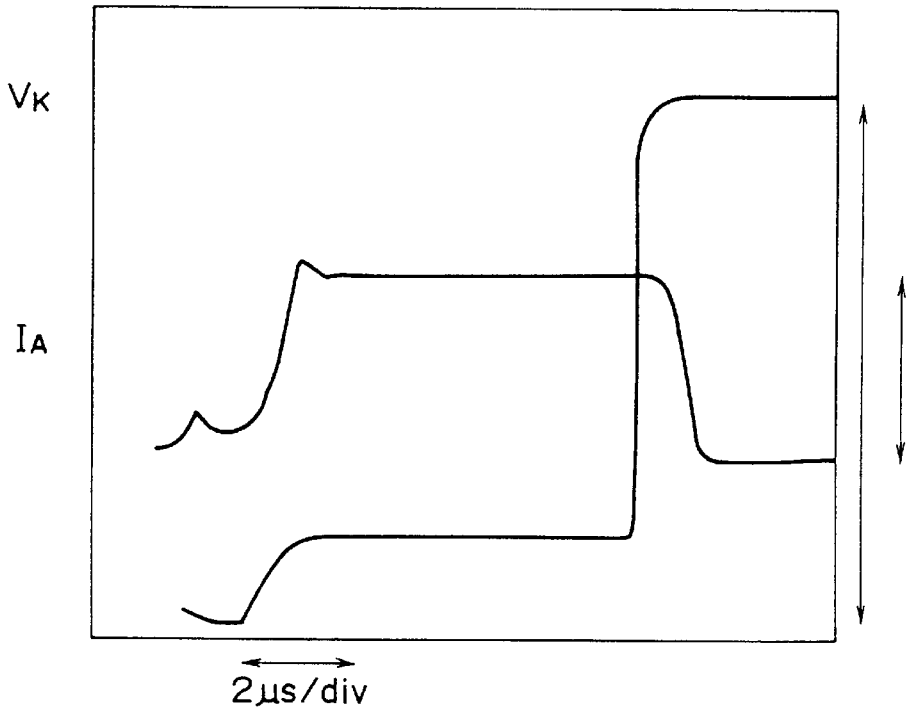
FIGS. 10A and 10B show waveforms of anode currents $I_A$ and cathode voltages $V_K$ obtained by the oscilloscope while changing the internal capacity of the plasma driving circuit.
Figure 10B:
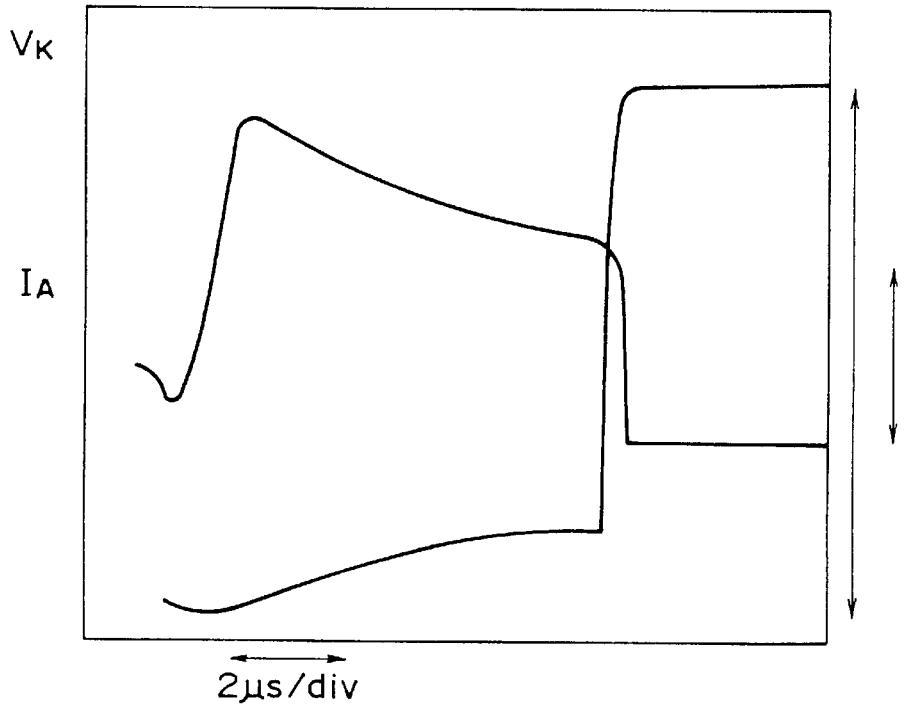

FIG. 10A shows a voltage-current waveform obtained when the internal capacity is 1 nF, and similarly FIG. 10B shows a voltage-current waveform obtained when the internal capacity is 10 nF. It is seen therefrom that, in case the internal capacity is 1 nF, the constant current response is fast as 1 $\mu$s or so. However, in a case where the internal capacity is 10 nF, the constant current response is rendered so slow as 10 $\mu$s, whereby the waveform is not kept at a fixed level during the discharge period. Thus, it is comprehended that, under the fixed conditions relative to the discharge voltage and the limit current, the rush current is increased correspondingly to the larger amount of the internal capacity of the plasma driving circuit, so that the time of occurrence of the picture distortion caused by the undesirable discharge is expedited to a considerably great extent. It is therefore important that the internal capacity of the plasma driving circuit be diminished in order to suppress any undesirable discharge.

It is presumed that, since the current determined by the internal capacity of the plasma driving circuit connected in series to the plasma flows in as a rush current in addition to the constant current limit, generation of undesirable discharge such as arc discharge is prone to occur. In view of the above presumption, the internal capacity of the plasma driving circuit and the condition of causing undesirable discharge were obtained by measuring the voltage and the current. As a result, it has been found that the smaller the internal capacity, the undesirable discharge generating voltage becomes higher and also the uniform discharge start voltage becomes higher as well.

Figure 11:
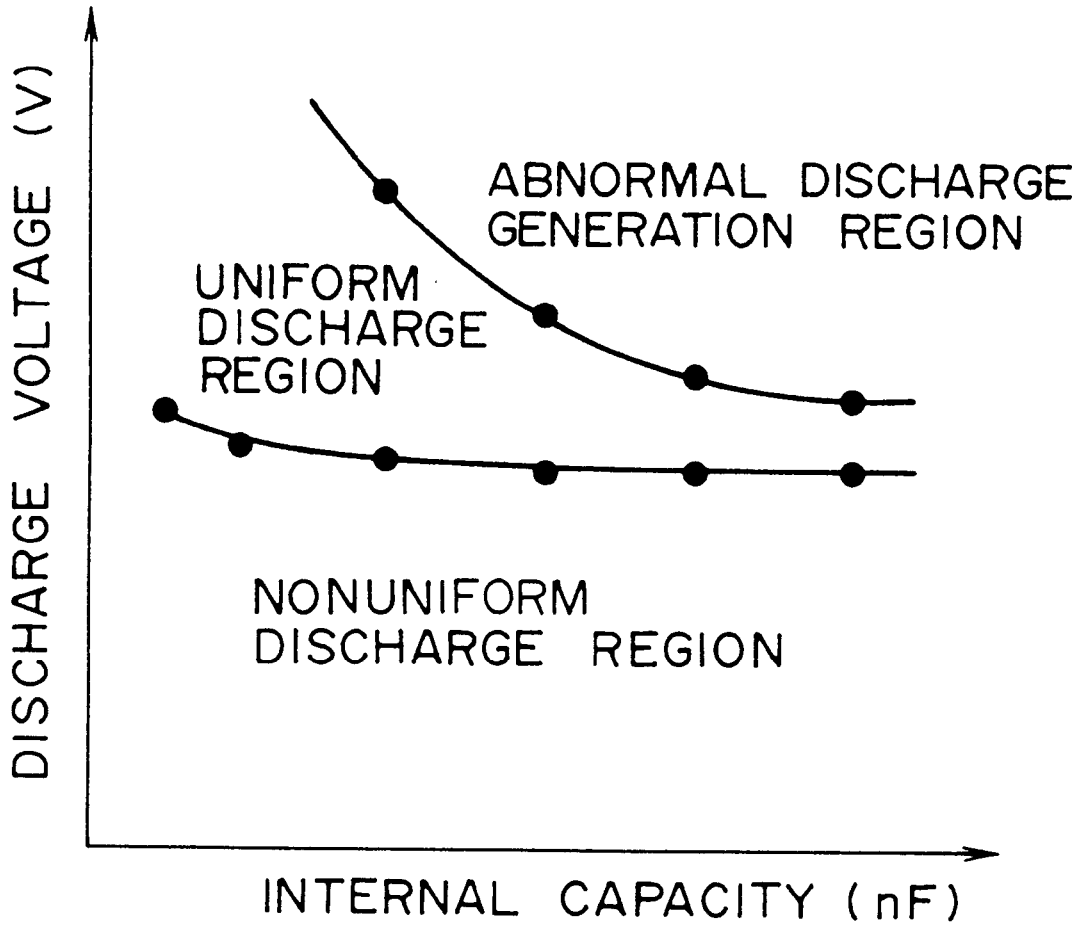
FIG. 11 graphically shows the relationship between the internal capacity and the discharge voltage.

FIG. 11 graphically shows the relationship between the internal capacity and the undesirable discharge start voltage, and also the relationship between the internal capacity and the uniform discharge start voltage. It is seen therefrom that, when the internal capacity of the plasma driving circuit is small, the voltage margin for attaining normal uniform discharge is rendered large. In a state of practical use, the best result is achievable by minimizing the internal capacity and generating plasma discharge at a voltage slightly higher than the uniform discharge start voltage.

Figure 12:
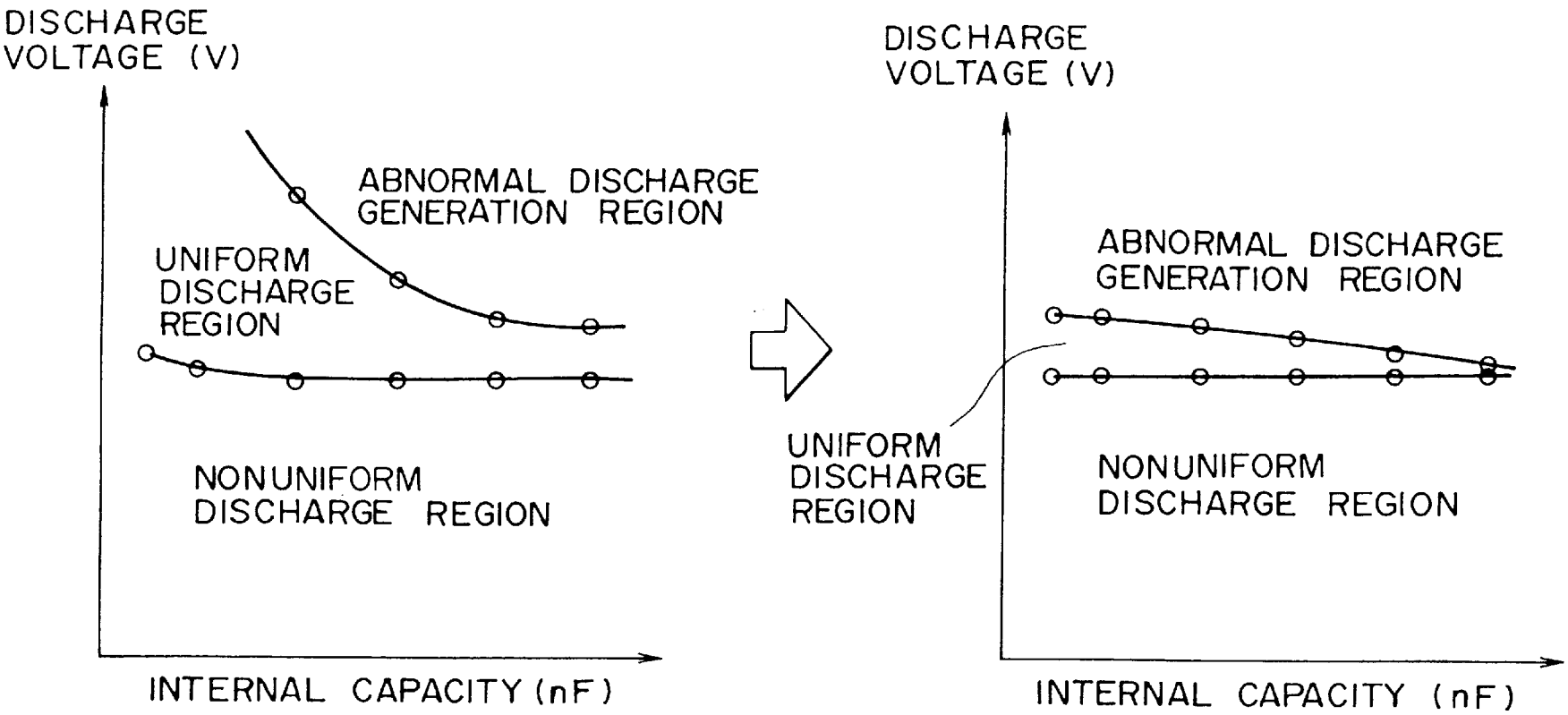
FIG. 12 graphically shows changes caused in the discharge voltage with a lapse of time.

If the internal capacity of the plasma driving circuit is large, the rush current other than the constant current limit is increased to consequently cause ready generation of undesirable discharge. The internal capacity and the undesirable discharge generating voltage and current were measured in regard to changes thereof with a lapse of time. FIG. 12 graphically shows the changes observed with a lapse of time in the relationship between the internal capacity and the uniform discharge start voltage and also in the relationship between the internal capacity and the undesirable discharge start voltage. With a certain lapse of the discharge time, the undesirable discharge generating voltage is gradually lowered, so that the voltage range adequate for uniform discharge is narrowed. In this case also, a smaller internal capacity is more advantageous since the voltage margin for attaining uniform discharge is rendered larger.

In the present invention, as mentioned above, a low-capacity diode element and, when necessary, a resistance element also, are inserted in series to each output of the plasma driving circuit. Due to this configuration, the internal capacity of the circuit can be reduced to consequently suppress any unrequired discharge rush current, hence diminishing the total discharge current to eventually prolong the service life of the plasma cell. As the uncontrollable discharge rush current is thus suppressed, there is achievable another advantageous effect of stabilizing the plasma discharge.

Although the present invention has been described hereinabove with reference to some preferred embodiments thereof, it is to be understood that the invention is not limited to such embodiments alone, and a variety of other modifications and variations will be apparent to those skilled in the art without departing from the spirit of the invention.

The scope of the invention, therefore, is to be determined solely by the appended claims.

What is claimed is:

1. A plasma driving circuit for sequentially driving a plurality of plasma channels, comprising:

a plurality of complementary switches provided correspondingly to said plasma channels, each of said complementary switches having a capacitive component which charges upon application of current to said plasma channels;

a constant current source connected in common to each of said complementary switches and supplying a predetermined discharge current thereto;

a scanner for sequentially controlling the on/off actions of said complementary switches and distributing said discharge current to the corresponding plasma channels to cause discharge in said plasma channels; and a suppressing means included in the output stage of each of said complementary switches and serving to suppress the output of a rush current which results from charging of a capacitive component existent in each of said complementary switches, said suppressing means suppressing the rush current into one of said plasma channels through said plurality of complementary switches of others of said plasma switches, said suppressing means including only resistive elements of sufficient resistance to suppress the rush current.

2. The plasma driving circuit according to claim 1, wherein said suppressing means is a diode element having a capacitive component sufficiently smaller than the capacitive component existent in each of said complementary switches, said diode element being connected in a polarity to suppress current flow through said complementary switches of said other plasma switches when initiating a discharge in said one plasma channel.

3. The plasma driving circuit according to claim 2, wherein said suppressing means is a resistance element connected in series to said diode element.

4. The plasma driving circuit for sequentially driving a plurality of plasma channels, comprising:

a plurality of complementary switches provided correspondingly to said plasma channels, said complementary switches each including a capacitative component;

a constant current source connected in common to each of said complementary switches and supplying a predetermined discharge current thereto;

a scanner for sequentially controlling the on/off actions of said complementary switches and distributing said discharge current to the corresponding plasma channels to initiate a discharge in the corresponding plasma channels; and a suppressing means included in the output stage of each of said complementary switches and serving to suppress the output of a rush current which results from the capacitive component existent in each of said complementary switches, said suppressing means suppressing the rush current into one of said plasma channels through said plurality of complementary switches of others of said plasma switches, wherein said suppressing means includes:

a diode element having a capacitive component sufficiently smaller than the capacitive component existent in each of said complementary switches, said diode element being connected in a polarity to suppress current flow through said complementary switches of said other plasma switches when initiating a discharge in said one plasma channel, and a resistance element connected in series with said diode element, wherein the resistance value of said resistance element is so optimized as not to limit the discharge current substantially but to be adapted for suppressing the rush current effectively, said resistance element being connected on a current flow path of said discharge current upon initiation of plasma discharge in said plasma channels.

5. A plasma addressed display device, comprising:

a display panel having a stacked structure consisting of a display cell with a plurality of data electrodes arrayed in columns, a plasma cell with plasma channels arrayed in rows, and a dielectric sheet interposed between said display panel and said plasma cell;

a plasma driving circuit for sequentially driving said plasm channels to thereby address said display cell line-sequentially, said plasma driving circuit having a plurality of complementary switches provided correspondingly to said plasma channels, a constant current source connected in common to each of said complementary switches and supplying a predetermined discharge current thereto, a scanner for sequentially controlling the on/off actions of said complementary switches and distributing said discharge current to the corresponding plasma channels, and a suppressing means included in the output stage of each of said complementary switches and serving to suppress the output of a rush current which results from a capacitive component existent in each of said complementary switches, said suppressing means including resistor elements of sufficient resistance to suppress said rush current, said rush current flowing through one of said plasma channels upon initiation of discharge through said complementary switches of others of said plasma channels; and a display driving circuit for supplying picture signals to said data electrodes in synchronism with the line-sequential addressing.

6. The plasma addressed display device according to claim 5, wherein said suppressing means is a diode element having a capacitive component sufficiently smaller than the capacitive component existent in each of said complementary switches.

7. The plasma addressed display device according to claim 6, wherein said suppressing means is a resistance element connected in series to said diode element.

8. The plasma addressed display device according to claim 7, wherein the resistance value of said resistance element is so optimized as not to limit the discharge current substantially but to be adapted for suppressing the rush current effectively.

* * * * *